United States Patent [19]

Pardo

[11] Patent Number: 4,776,144

[45] Date of Patent: Oct. 11, 1988

[54] ROOF PAVER CONNECTOR AND SYSTEM

[75] Inventor: Jorge Pardo, Reston, Va.

[73] Assignee: National Concrete Masonry Association, Herndon, Va.

[21] Appl. No.: 33,741

[22] Filed: Apr. 3, 1987

Related U.S. Application Data

[63] Continuation-in-part of Ser. No. 696,710, Jan. 31, 1986, Pat. No. 4,655,018.

[51] Int. Cl.[4] ..... E04C 1/10

[52] U.S. Cl. ..... 52/585; 403/298

[58] Field of Search ..... 52/585, 408, 602, 513, 52/302, 506, 379, 229; 403/292, 298

[56] References Cited

U.S. PATENT DOCUMENTS

| | | | |
|---|---|---|---|
| 706,974 | 8/1902 | Lyle . | |
| 723,892 | 3/1903 | Lyle . | |
| 825,069 | 1/1906 | Peirce . | |
| 1,142,518 | 6/1915 | Hinde . | |
| 3,036,407 | 5/1962 | Dixon | 52/585 |
| 3,760,547 | 9/1973 | Brenneman . | |
| 3,767,233 | 10/1973 | Hodge | 403/292 X |
| 3,826,056 | 7/1974 | Smith et al. . | |
| 3,864,885 | 2/1975 | Muse . | |
| 3,986,429 | 10/1976 | Busler . | |
| 4,068,346 | 1/1978 | Binder | 403/292 X |
| 4,110,949 | 9/1978 | Cambiuzzi et al. . | |
| 4,454,699 | 6/1984 | Strobl . | |
| 4,571,910 | 2/1986 | Cosentino . | |

FOREIGN PATENT DOCUMENTS

| | | | |
|---|---|---|---|
| 606876 | 11/1934 | Austria | 52/585 |
| 2733311 | 2/1979 | Fed. Rep. of Germany | 52/588 |

*Primary Examiner*—Carl D. Friedman
*Attorney, Agent, or Firm*—Lane & Aitken

[57] ABSTRACT

A roof paver system includes a plurality of roof paver elements having alternating dovetail-shaped and tapered grooves and an upper surface having raised portions to generate vortices for preventing wind from lifting the elements and to provide a safety tread. Connector members are provided in some of the dovetail grooves to interconnect the roof paver elements to further prevent their displacement. The tapered grooves break the vacuum between the roof paver elements and the molds in which they are formed. Some of the dovetail grooves are composite grooves defined by the cooperation of adjacent roof paver elements. Clips are provided to mate with outwardly projecting toes on the roof paver elements in perimeter courses to align and anchor them, and elongate battens, which are dovetail-shaped in cross section, are received in the dovetail grooves and include openings for receiving thin elements transverse to the battens to engage the concrete elements at the ends of the grooves.

In one embodiment, the connector members have a truncated triangular cross section to provide a substantial area of contact with the walls of the dovetail grooves and ridges to bind against the walls. Flange stops project from the connector members to engage the roof paver elements at the ends of the dovetail grooves, and one end of the connector member has a bevel to mate with a roof paver element oriented with its grooves perpendicular to the connector member.

19 Claims, 5 Drawing Sheets

ROOF PAVER CONNECTOR AND SYSTEM

CROSS REFERENCE TO RELATED APPLICATION

This is a continuation-in-part of Ser. No. 696,710,filed on Jan. 31, 1985 now U.S. Pat. No. 4,665,018 and entitled "Roof Paver Element and System".

BACKGROUND OF THE INVENTION

The present invention relates to a roof paver element and a roof paver system including a plurality of interconnected roof paver elements for covering roofs and, especially, for covering the membranes of single-ply roofing systems.

For most types of low-slope roofs, roof ballast is used to hold down the roofing membrane against the roof deck when wind conditions may create negative pressures tending to lift the membranes. The ballast also protects the membranes from ultraviolet radiation and puncture or impact damage by maintenance crews and wind-blown objects. The standard form for roof ballast has traditionally been a smooth, round "river wash" type of gravel which is spread uniformly to produce a minimum of 10 lb/sf (237 kg/m$^2$) load on the membrane. However, the use of gravel as roof ballast has been revised in recent years in light of the development of new single-ply roofing systems and the extensive damage caused to buildings near gravel ballast roofs as the result of flying gravel in hurricane type conditions. New single-ply roofing membranes, as opposed to the conventional multi-ply "built up" roofing systems, do not use hot bitumen for holding the membranes in place, and in some cases, the single-ply membranes are laid loosely on the roof deck without fasteners other than at the perimeter, which means that heavier than usual ballast is desirable to keep the membrane down. In addition, because the gravel ballast does not adhere to the single-ply membranes as it adhered to the bitumen in the asphalt-based systems, there is a greater potential hazard of gravel flying under extreme wind conditions.

In order to overcome the drawbacks of gravel ballast, flat concrete paver elements and systems have been developed which provide adequate ballast to hold down the roof membrane and protect it from ultraviolet radiation and impact damage, but each suffers from at least one of several disadvantages. Some of the prior art roof paver elements require for their manufacture special concrete molding equipment, drying racks and handling equipment, even though they are produced by manufacturers already having conventional equipment of the same types for producing standard concrete blocks. This is due to the fact that the designs of the known paver elements require the elements to have non-standard dimensions to provide roof drainage or for other purposes, and even with such special dimensions, the provision for roof drainage is not always adequate and/or permits drainage in only one direction. Roof paver elements have flat upper surfaces which allow air to flow uninterrupted across the elements at high speeds, producing negative pressures which can lift and displace the elements. In addition, known roof paver systems do not provide a convenient arrangement for aligning and anchoring the paver elements in courses around the perimeter of the roof or a system for preventing the paver elements from sliding when they are installed in roofs having slopes higher than 1 inch per foot.

SUMMARY OF THE INVENTION

In accordance with the present invention, a roof paver system includes roof paver elements which can be produced in a standard concrete block mold machine, dried on standard drying racks and handled with conventional concrete block material handling equipment. The length and height of the paver elements correspond to two of the dimensions of a standard concrete block mold machine, and the width of the elements is such that a plurality of such elements can be accommodated at one time in the mold.

Each roof paver element has a larger footprint than previously known roof pavers, that is, a larger proportion of its surface area contacts the roof to provide a greater weight distribution and a reduced likelihood of damage to the roof membrane or its substrate. The roof paver elements according to the present invention allow a far greater drainage volume than other roof paver elements by providing more and larger drainage grooves, and they permit the drainage in two directions. The elements have a higher thermal insulating value than previously known roof paver elements by their ability to trap a large volume of air in the drainage grooves, and, by tapering alternate drainage grooves, the roof paver elements provide a mechanism for immediately breaking the vacuum between the elements and the concrete mold when the elements are formed, thereby reducing forces which retain completed elements in the mold and increasing the speed and ease with which the elements can be molded.

The ends of the elements cooperate with one another to define composite drainage grooves for receiving and retaining separate connecting members or interlocking the elements to provide an integrated roof paver system, thereby preventing individual elements from being lifted and moved out of position by high winds or traffic. The drainage grooves within each element which are not tapered are shaped like the composite grooves, providing a relatively narrow space at the roof membrane but increased area above for greater drainage. The effect of high winds is also diminished by the provision of raised portions on the top surface of each roof paver element for generating air vortices to break up the smooth flow of air which tends to lift the elements as it moves across them. The raised portions also define a safety tread which helps prevent workmen from slipping.

For some installations, such as those roofs having a lower perimeter fascia, the roof paver system employs clips along its perimeter for aligning the roof paver elements at the start of laying and for anchoring them to the roof. For roofs having high slopes, the system includes elongate battens securable to the roof membrane and shaped to be slid into and retained in the shaped alternate grooves to accommodate transverse stop members for abutting the downslope edge of the paver elements.

A preferred connecter has a tubular body portion to allow drainage and includes flange stops projecting to engage the ends of ribs defining the drainage grooves in the roof paver elements. The flange stops are positioned closer to one end of the connector member than the other to facilitate the connection of one end of a roof paver element, in which the ends of the ribs are flush with a generally planar portion of the element, with the opposite end of an adjacent roof paver element, in which the ends of the ribs are recessed from the planar portion, thus preventing the connector from being inserted too deeply into one paver and not sufficiently into its adjacent mate. The connector member has a cross-sectional shape providing a large area of engagement between the connector member and the surfaces of the paver elements defining the groove. Resilient ridges project from the connector member at its ends and engage substantial areas of the groove-defining surfaces to resist removal from the groove, especially when the wind tries to lift one of the paver elements relative to the others. The ridges can be formed as a part of the body portion, and the entire connector member can be made of a resilient material, such as polyethylene. The ridges render the connector member far more resistant to removal than ridgeless connector members of the same configuration while providing additional reinforcing against buckling. At some locations on a roof, it is desirable to orient the grooves of some paver elements perpendicular to the grooves of adjacent paver elements. The connector member has one end which is bevelled to mate with a sloped surface on an end rib of a paver element whose ribs are perpendicular to the ribs of the adjacent paver elements receiving the opposite end of the connector member. The connector members have indicia for indicating the proper direction for inserting the connector member into the grooves in most instances.

DETAILED DESCRIPTION OF THE PREFERRED EMBODIMENTS

Figure 1:
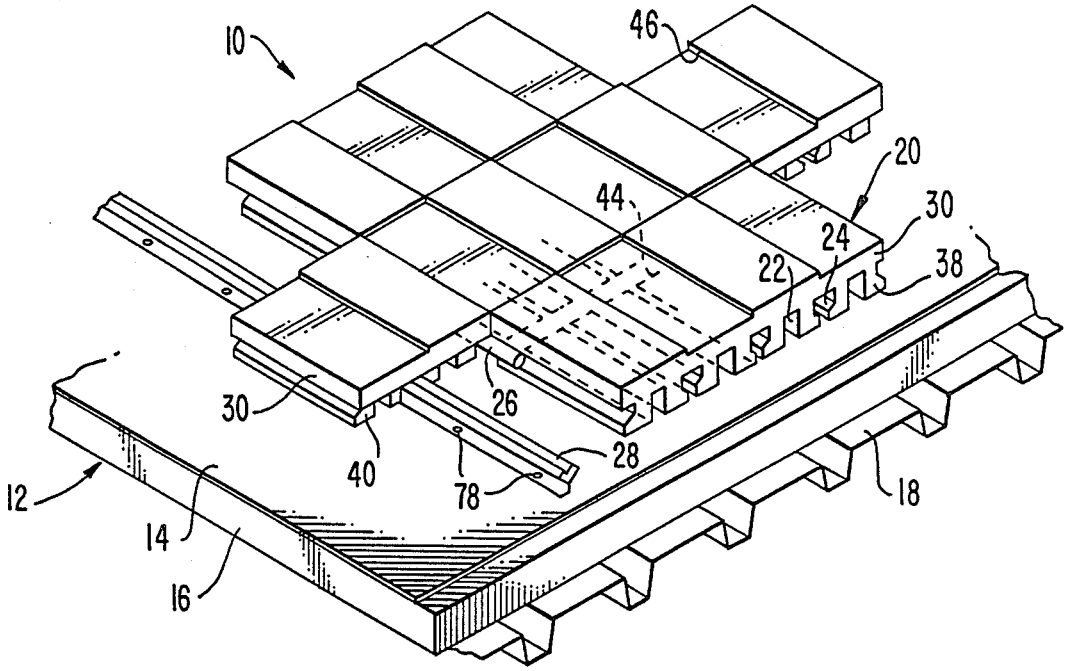
FIG. 1 is a perspective view of a roof paver system in place on a roof.

In FIG. 1 of the drawings, an exemplary embodiment of an integrated roof paver system 10 according to the present invention is shown in place on a roof 12, in which a roof membrane 14 overlies insulation 16 on top of a roof deck 18. The roof paver system 10 includes a plurality of roof paver elements 20, four of which are shown, each of which contains a plurality of tapered grooves 22 and alternating dovetail-shaped grooves 24 on the underside to allow the drainage of water and to trap air for thermal insulation. In addition, the dovetail grooves 24 receive connector members 26, such as standard one-inch plastic tube connectors, to positively interlock the roof paver elements 20 in the system 10, and dovetail-shaped battens 28 to secure the paver elements 20 to the roof 12 and to keep the paver elements from sliding on roofs having a relatively high slope. In the embodiment illustrated, the courses of roof paver elements 20 are staggered to permit total interlocking of the roof paver system 10, but it is understood that the roof paver elements 20 of adjacent courses can be in alignment if desired.

Figure 2:
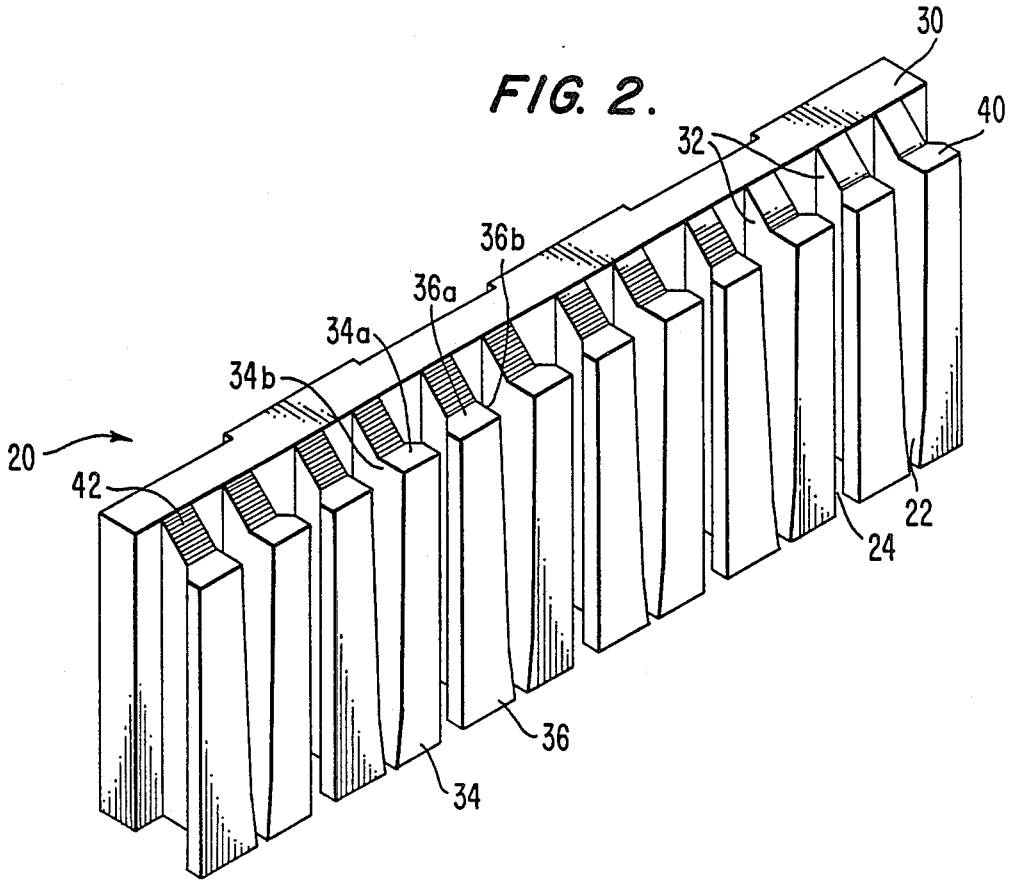
FIG. 2 is a perspective view of a roof paver element according to the present invention.

As can be seen from FIG. 2, the roof paver element 20 is a thin shell block element preferably made of concrete and having dimensions which permit it to be molded readily in a standard concrete block mold box. For this reason, a preferred embodiment of the roof paver element has nominal dimensions of 16 in.×8 in.×2.5 in. so that a mold box which can produce, for example, three standard concrete blocks at a time can produce eight thin shell roof paver elements at a time. A roof paver element 20 according to the present invention having the above dimensions has a ballast weight of 11 pounds per square foot, a coverage of 0.88 square feet, a footprint of 81.5 square inches per square foot of coverage (56%), and an insulating value of 1.6 R (sf). The roof paver element 20 includes an elongate planar portion 30 which defines the upper portion of the paver element 20 when it is in place on a roof, and projecting from the planar portion 30 are a plurality of spaced ribs 32 terminating in broadened feet 34 and 36 which include toe portions **34*a* and 36*a*, respectively, and heel portions 34*b* and 36*b*. The area of the feet 24 and 26 which contacts the roof, that is, the footprint, is made greater than the cross-sectional area of the ribs 32 to provide increased weight distribution and to diminish the likelihood of damage to the roof membrane or its substrate. The dovetail grooves 24 are defined between adjacent ribs 32 and facing toe portions 34*a* and 36*a* of the feet 34 and 36, so that the region above the toe portions 34*a* and 36*a* has an increased cross-sectional area to accommodate a large volume of drainage. The tapered grooves 22, which are defined between adjacent ribs 32 and the heel portions 34*b* and 36*b* of the feet 34 and 36, taper longitudinally to provide a mechanism for breaking the vacuum between the tapered grooves 22 and the mold as the roof paver elements 20 are slid out of the mold in a direction parallel to the grooves 22 and 24. The breaking of the vacuum between the tapered grooves 22 and the portions of the mold they contact reduces the overall forces retaining the paver elements 14** in the mold so that the elements can be slid out easily.

The feet 34 and 36 are shorter than the parallel dimension of the plannar portion 30, each foot having a flush end 38 which is coplanar with an edge of the planar portion 30 and a recessed end 40 which is connected by a bevelled portion 42 of the ribs 32 to an opposite edge of the planar portion 30, as can best be seen from FIGS. 1 and 2. When the paver elements 20 are in place on roof, the space between the recessed ends 40 of the feet 34 and 36 and the adjacent edge of the planar portion 30 defines with the bevelled portions 42 of the ribs 32 a drainage passage which is transverse to the drainage provided by the dovetail grooves 24 and the tapered grooves 22. FIG. 1 shows in dotted lines a transverse drainage passage 44 of double width defined by the juxtaposition of the recessed ends 40 of the feet 34 and 36 of one paver element 20 with the recessed ends 40 of the paver elements 20 in the adjacent course. By this arrangement, a double width transverse drainage passage 44 is defined after every two courses of paver elements 20, there being no significant transverse drainage at the abutment of the paver elements between the drainage passages 44. The paver elements 20 can also be laid with the recessed ends 40 in each paver element 20 juxtaposed with the flush ends 38 of the feet 34 and 36 of paver elements 20, so that a transverse drainage passage of single width is defined after every course of paver elements 20.

Figure 3:
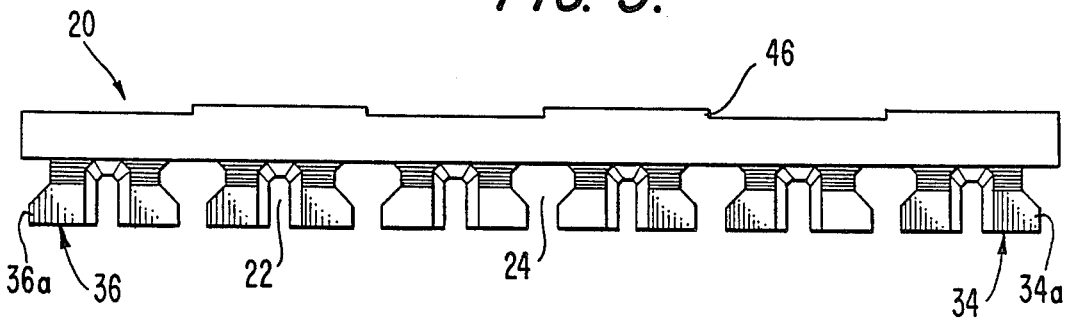
FIG. 3 is a top view of the roof paver element of FIG. 2.
Figure 4:
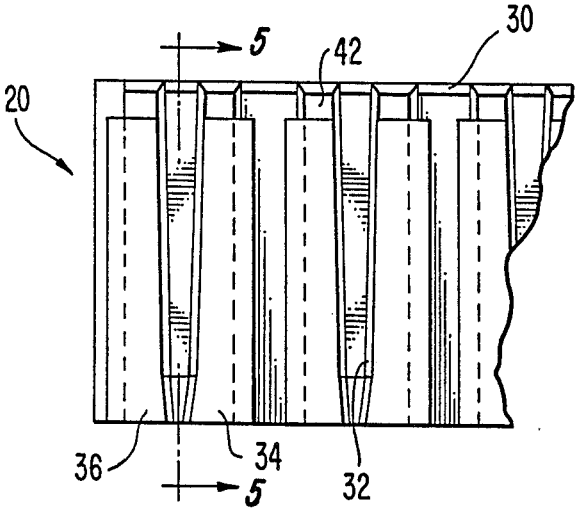
FIG. 4 is a partial front view of the roof paver element of FIG. 2.
Figure 5:
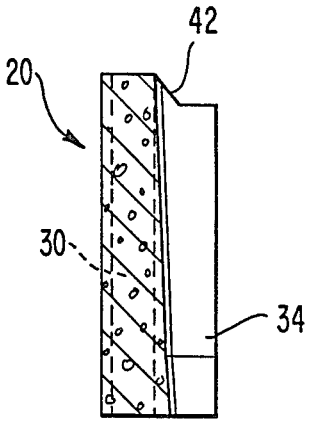
FIG. 5 is a cross-section taken along the line 5—5 in FIG. 4.

As can best be seen from FIG. 1 and 3, the roof paver elements 20 have bar-shaped rasied portions 46 on their upper surfaces, so that when the roof paver elements 20 are in place on a roof, the raised portions 46 provide a tread for roof traffic, such as maintenance crews and repairmen, and also constitute vortex generators which break up the flow of air along the roof paver elements, which can cause uplift and displacement of the elements, by creating swirls of air which reduce the negative pressure causing the uplift.

Each paver element 20 terminates at its ends with structure defining one half of a dovetail groove 24. Specifically, each end of the paver element 20 includes a rib 32 spaced inward from the lateral edge of the planar portion 30 by a distance equal to one half the width of a dovetail groove 24 and a foot 34 or 36 having an outwardly directed toe 34*a* and 36*a*, so that when the end of the paver element 20 is laid in abutment with the end of the adjacent paver element, a composite dovetail groove 24 for receiving the connector members 26 is defined, as can be seen in FIG. 1. The connector members 26, which are received snugly between aligned dovetail grooves 24 in adjacent roof paver elements 20 further prevent the displacement of the elements. The dovetail grooves 24 which lie entirely within one roof paver element 20 also can receive the connector members 26, as shown in FIG. 1, so that a connector member can have one end inserted in a composite dovetail groove 24 and the other end inserted in a dovetail groove 24 lying entirely within one roof paver element 20. The connector members 26 can also connect two dovetail grooves 24 lying entirely within their respective roof paver elements 20 and, where the roof paver elements of adjacent courses are in alignment, the connector members 26 can connect two composite dovetail grooves 24.

Especially in cases where the connector members 26 are used in dovetail grooves 24 defined entirely by one roof paver element 20, stops, such as radial projections 37, for engaging the ends of the ribs 22 or feet 34 and 36 are provided to prevent the connector members 26 from being pushed too far into the dovetail grooves 24 in a roof paver element 20 in one course by the element in the next course as it is being moved into abutment with the element in the first course. Although connector members 26 are employed in only two of the dovetail grooves 24 in each roof paver element 20 illustrated in the embodiment of FIG. 1, any number of the remaining dovetail grooves 24 can be employed to receive additional connector members 26 if stronger integration of the roof paver elements 20 is desired.

Figure 6:
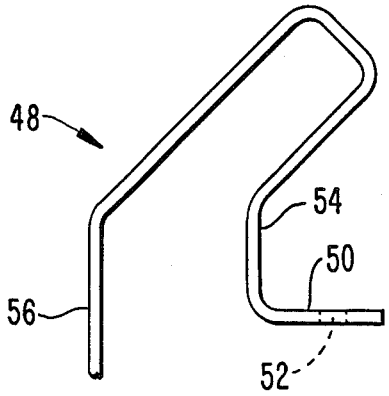
FIG. 6 is a side view of a perimeter clip according to the present invention.
Figure 7:
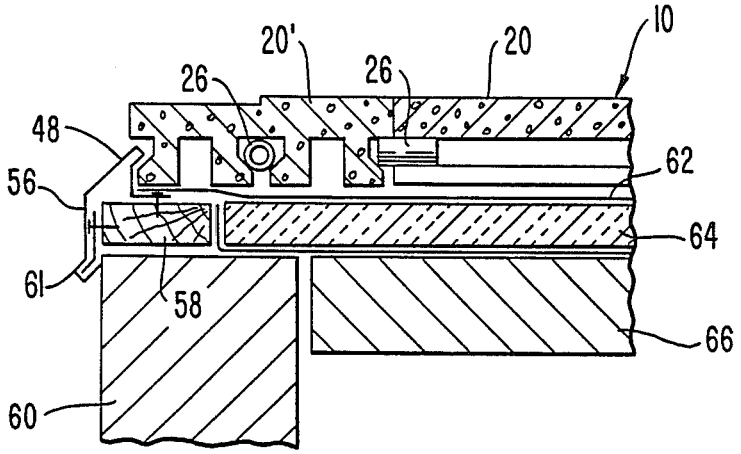
FIG. 7 is a schematic cross section of a roof paver system installation employing the perimeter clips of FIG. 6.
Figure 8:
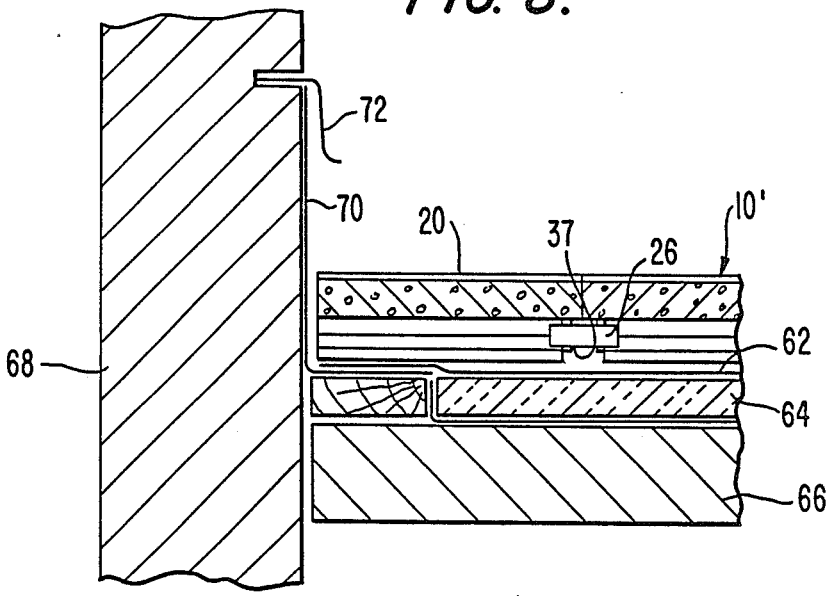
FIG. 8 is a schematic cross section of another roof paver system installation.
Figure 9:
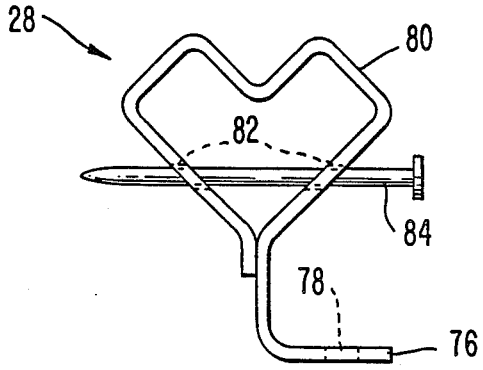
FIG. 9 is an end view of a batten according to the present invention.
Figure 10:
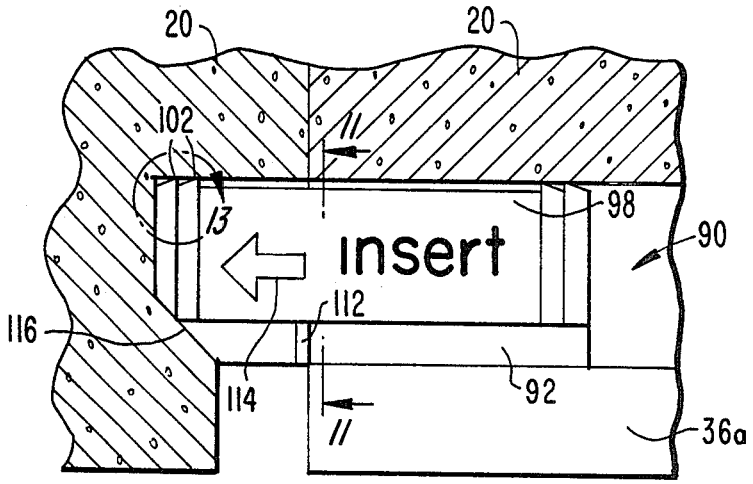
FIG. 10 is a side view of a preferred connector member for the roof paver system according to the present invention and portions of two roof paver elements.

In order to allow the alignment of the roof paver elements 20 at the perimeter of the roof paver system 10, and to anchor the elements in place, anchoring and alignment devices such as the clip 48 illustrated in FIG. 6 are provided. The clip 48, which can be made, for example, of metal or plastic, includes a base portion 50 having at least one aperture 52 for receiving nails or other fasteners, an angular portion 54 shaped to mate with the outwardly directed toe 36*a* at the end of a roof paver element 20′ and a fascia portion 56. As can best be seen from FIG. 7, in which a portion of the roof paver system 10 is shown on a roof, the clips 48 can be nailed to a nailer 58 at the top of a wall 60. The fascia portion 56 extends down past the side of the nailer 58 and terminates in an inwardly directed hook position 61, which engages the wall 60. A membrane 62, which overlies insulation 64 on top of a roof deck 66, can also overlie the base portion 50 of the clips 48 which have been secured to the nailer 58. The clips 48 constrain the end of the perimeter course roof paver element 20′, which in this case is one half of the element 20 shown in FIG. 2 and is laid perpendicular to the course of roof paver elements inside the perimeter course. The dovetail grooves 24 of the roof paver elements 20′ in the perimeter course can be secured to one another by the connector members 26, and the elements 20′ of the perimeter course can be connected to the inner elements 20 by connector members extending from the dovetail grooves 24 of the inner members and received perpendicularly in the one half dovetail groove, between the toe 34*a* and the lower surface of the planar portion 30, defined at the inner end of the elements 20′. FIG. 8 shows another installation of a roof paver system 10′ on a roof having a parapet 68, including flashing 70 and counterflashing 72, for which the perimeter clips 48 are not needed.

As is illustrated in FIG. 1, the roof paver system 10 can also include the elongate battens 28 for holding down the roof paver elements 20 and for preventing them from sliding, especially on roofs having a relatively high slope. The battens 28 can be made of metal or plastic, for example, like the clips 48 and include a base portion 76 including a plurality of spaced apertures 78 for receiving nails or other fasteners to secure the battens 28 to the roof. The dovetail shaped grooves 24 of the roof paver elements 20 are slidingly received on the battens 28, which have a complementary portion 80 dovetail shaped in cross section, by which the battens 28 hold the paver elements 20 down. The battens 28 include a plurality of spaced transverse openings 82 defined, for example, in the dovetail portion 80 and sized to receive a nail 84 or other thin element which engages the ends of the ribs 32 or feet 34 and 36, thereby preventing the paver elements from sliding along the battens 28.

Although the roof paver element is described herein as being made of concrete, other suitable materials may be employed, such as ceramics or plastics. Furthermore, the roof paver elements may be employed in structures other than as a part of a roof paver system.

An embodiment of a connector member which is especially well-suited for connecting roof paver elements 20 according to the present invention is designated generally by the reference numeral 90 in FIGS. 10–16. As can best be seen from FIGS. 10–13, the connector member 90 is tubular and has the cross-sectional shape of a truncated triangle, wherein the corners of the triangle are missing in favor of short joining walls 92 and 94 joining three main walls: a bottom wall 96 and side walls 98 and 100.

A plurality of resilient ridges 102 project laterally at the ends of the connector member 90 from the side walls 98 and 100 and from the joining wall 94, which joins the side walls 98 and 100 so that the connector member 90 engages substantial areas of the portions of the roof paver elements 20 defining the dovetail grooves 24. As can best be seen from FIGS. 10 and 13, each ridge 102 includes a surface 104 projecting substantially perpendicularly from the side walls 98 and 100 and the joining wall 94, and a surface 106 extending at a low angle to the side walls 98 and 100 and the joining wall 94 from a line at or near the end of the connector member 90 toward the axial center of the connector to meet the substantially perpendicular surface 104 and thereby define and edge. The shape of the ridges 102 permits the connector member 90 to be slid easily into the dovetail shaped grooves 24 of the roof paver elements 20 and allows roof paver elements to be slid over a connector member 90 which is already in place on a roof, since the ridges 102 deform easily in that direction, but prevents the connector member 90 from sliding out of a dovetail groove 24, since the ridges 102 do not deform easily when the perpendicular surfaces 104 face in the direction of movement and the sharp edges of the ridges 102 bind on the paver element surfaces defining the dovetail groove 24 when the connector member 90 is moved in a direction out of the dovetail groove.

The joining walls 92 have exterior surfaces parallel to and resting on sloped surfaces 108 on the toe portions 34*a* and 36*a* of the ribs 32 of the roof paver elements 20. In addition, the joining wall 94 is parallel to an undersurface 110 of the planar portion 30, which is oriented at an acute angle with respect to the sloped surfaces 108. Thus, there is a significant area of contact on three sides of the connector member 90 between the connector member and the roof paver elements 20, which is in contrast to the line contact which would occur between a connector member of circular cross section and the roof paver elements 20.

When any of the roof paver elements 20 are tilted with respect to the connector members 90, as would occur when the wind lifts a roof paver element, the connector member 90 binds even more tightly against the roof paver elements 20.

Figure 11:
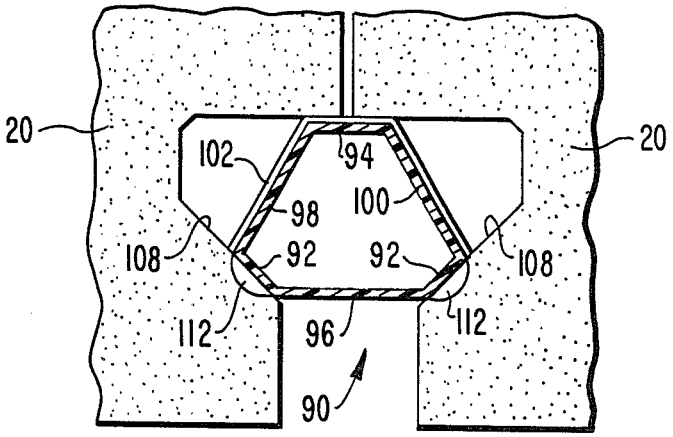
FIG. 11 is a cross section taken along the line 11—11 in FIG. 10, showing the connector member in place in a drainage groove defined between two other roof paver elements.
Figure 12:
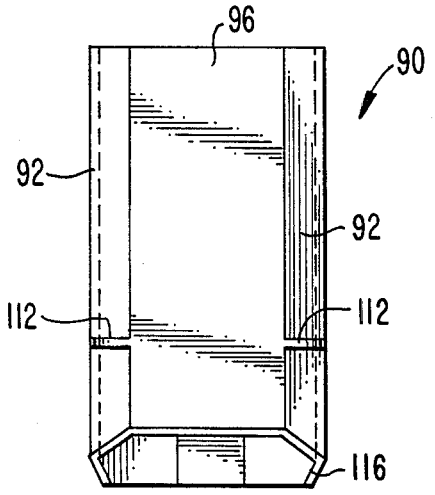
FIG. 12 is a bottom view of the connector member of FIG. 10.
Figure 13:
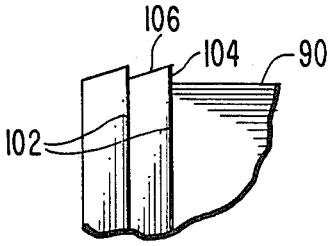
FIG. 13 is a partial enlarged view of ridges shown on the connector member of FIG. 10.
Figure 14:
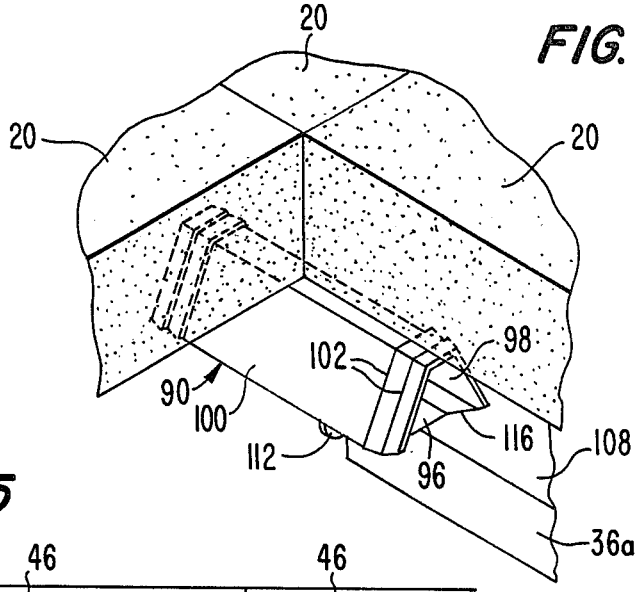
FIG. 14 is a perspective view of the connector member of FIG. 10 in position at the juncture of roof paver elements.

Stop elements in the form of flange stops 112 project from the joining walls 92 to engage the ends of the ribs 32 of the paver elements, as can best be seen in FIG. 11. As is shown in FIG. 14, the flange stops 112 are positioned closer to one end of the connector member 90 than the other to assure that both ends of the connector member 90 extend into their respective dovetail grooves 24 when connecting an end of a roof paver element 20 at which the ends of the ribs 32 are flush with the edge of the body portion, or planar portion, 30 with an end of a roof paver element 20 at which the ends of the ribs 32 are recessed from the edge of the planar portion 30. The positioning of the flange stops 112 is such that the connector member 90 extends equally into all of the dovetail grooves 24. More specifically, the flange stops 112 are offset from the longitudinally axial center of the connector member 90 by a distance equal to one half the distanct between recessed ends of the ribs 32 and the adjacent edge of the body portion 30. The flange stops 112 have a curved periphery so that the connector members 90 can be molded without requiring mold recesses which are diffucult to keep clean, and the connector members 90 are well suited to be made of plastic, such as polyethylene.

Figure 15:
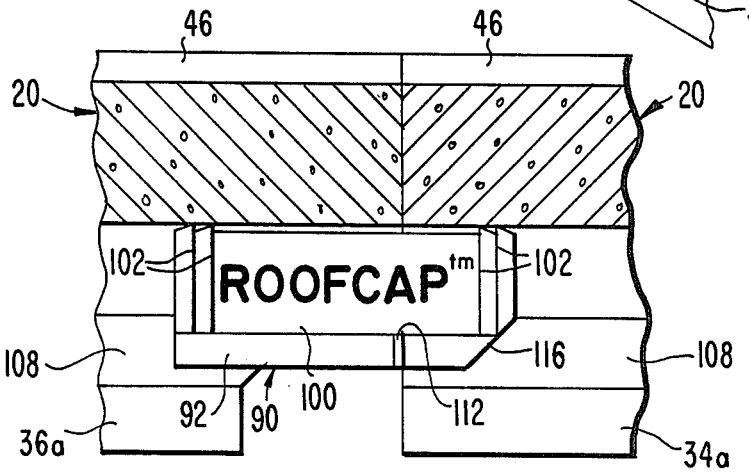
FIG. 15 is a side view of the connector member of FIG. 10 connecting paver elements in which the drainage grooves of the paver elements are in alignment.

Indicia 114, such as an arrow and the word "INSERT", are provided on the connector member 90, for example, on the side wall 98, to indicate the end of the connector member to be inserted into the flush ends of the paver elements 20. On the opposite side wall, side wall 100, identifying information can be molded, such as a trademark. "ROOFCAP", which is shown in FIG. 15, is a trademark of the National Concrete Masonry Association, the assignee of the present application. In order to provide connection between paver elements 20 when the dovetail grooves 24 of some paver elements 20 are perpendicular to the dovetail grooves 24 of adjacent paver elements 20, one end of the connector member 90 includes a chamber of bevel 116 defined by the bottom wall 96, the joining walls 92, and portions of the side walls 98 and 100, the angle of the bevel 116 corresponding to the angle of the sloped surfaces 108 on the toe portions 34a and 36a of the ribs 32. As a result, as can best be seen in FIG. 15, the connector member 90 extends all of the way into a recess defined by the sloped surface 108 and the undersurface 110 of the planar portion 30 and engages a vertical surface 118 of the rib 32 between the sloped surface 108 and the undersurface 110, in addition to having a substantial area of contact with the sloped surface 108. When the connector member 90 is in such a position, the ridges 102 engage the undersurface 110 of the planar portion 30. Any lifting or tilting of the roof paver element 20 engaging the bevelled end of the connector member causes the angled edges on the ridges 102 to engage the undersurface 110 more tightly and thereby resist the separation of the roof paver element 20 from the connector member 90.

Thus, it will be appreciated that as a result of the invention, a highly effective roof paver element and system is provided for covering roofs, and that it will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A connector for connecting block elements having ribs defining open-ended grooves comprising:

a tubular body having open ends and a shape in cross section of a truncated triangle and defining an axis;

at least one stop element extending laterally from said tubular body for engaging one of the ribs; and at least one resilient ridge projecting laterally from said tubular body adjacent each of said open ends, said resilient ridges each being defined by a first surface substantially perpendicular to said tubular body and a second surface extending at an acute angle from said tubular body toward the axial center of said tubular body and terminating at said first surface to define an edge with said first surface, whereby said resilient ridges deform easily upon insertion into an open-ended groove relative to the deforming of said resilient ridges upon removal from an open-ended groove, wherein said tubular body includes three main walls and joining walls connecting said three main walls, said joining walls having a width smaller than the width of said three main walls, and said stop element projects laterally from one of said joining walls.

2. The connector of claim 1, wherein a plurality of said resilient ridges project adjacent each of said open ends.

3. The connector of claim 1, wherein said stop element is positioned closer to one of said open ends of said tubular body than to the other of said open ends.

4. The connector of claim 1, wherein said resilient ridges project laterally from two of said three main walls and one of said joining walls.

5. The connector of claim 1, wherein said stop element has a curved peripheral surface.

6. The connector of claim 1, wherein said resilient ridges are made of plastic.

7. The connector of claim 1, wherein the connector further comprises indicia indicating the proper direction for inserting the connector into an open-ended groove.

8. The connector of claim 1, wherein said tubular body includes three main walls and joining walls connecting said three main walls, and a bevel at one of the open ends of said tubular body, said bevel being defined by one of said main walls and two of said joining walls adjoining said one main wall.

9. A roof paver system for providing ballast for a roof comprising:

a plurality of roof paver elements having ribs defining a plurality of drainage grooves; and a plurality of connectors positioned within the drainage grooves of the roof paver elements in order to connect each roof paver element to adjacent roof paver elements, wherein each said connector includes a tubular body having open ends and defining an axis, and at least one resilient ridge projecting laterally from said tubular body adjacent each of said open ends, each said resilient ridge being defined by a first surface substantially prependicular to said tubular body and a second surface extending at an acute angle from said tubular body toward the axial center of said tubular body and terminating at said first surface to define an edge with said first surface, whereby said resilient ridges deform easily upon insertion into a drainage groove relative to the deforming of said resilient ridges upon removal from a drainage groove.

10. The roof paver system of claim 9, wherein said ribs have planar surface and said roof paver elements include body portions having planar surfaces, wherein said planar surfaces of said ribs and said body portions define said drainage grooves, and said tubular body includes a plurality of planar surfaces contacting the planar surfaces of said ribs and said body portions over an area.

11. The roof paver system of claim 9, wherein said ribs have ends and said connectors include stop elements extending laterally from said tubular bodies for engaging the ends of said ribs.

12. The roof paver system of claim 11, wherein said body portions have edges, the ends of said ribs include first ends flush with said edges and second ends recessed from said edges to define drainage passages transverse to said drainage grooves, said roof paver elements are positioned next to one another such that the flush rib ends of one roof paver element are adjacent the recessed rib ends of an adjacent roof paver element, one open end of each said tubular body is positioned in a drainage groove at the flush rib ends of one roof paver element and the other open end of each said tubular body is positioned in a drainage groove at the recessed rib ends of an adjacent roof paver element, and the stop elements are positioned closer to said one open end that to said other open end.

13. The roof paver system of claim 12, wherein the distance between the axial center of the tubular body and said stop member is one half the distance between the recessed ends of the ribs and the adjacent edge of the body portion, so that the open ends of said tubular body extend equal distances into the drainage groove at the flush ends of the ribs and the drainage grooves at the recessed ends of the ribs.

14. The roof paver system of claim 12, wherein the connector further comprises indicia indicating the open end of said tubular body to be inserted into a drainage groove at the flush ends of the ribs.

15. The roof paver system of claim 9, wherein the ribs of some roof paver elements are perpendicular to the ribs of adjacent roof paver elements, and the ribs of said some roof paver elements include end ribs having sloped surfaces exposed to the grooves of said adjacent roof paver elements; and one of said open ends of the tubular body of each said connector being positioned in one of the drainage grooves of said adjacent roof paver elements, the other of said open ends of the tubular body having a bevel surface parallel to and in contact with one of said sloped surfaces of said some roof paver elements.

16. The roof paver system of claim 15, wherein said tubular body includes three main walls and joining walls connecting said three main walls, said bevel surface being defined by one of said main walls and two said joining walls adjoining said one main wall.

17. The roof paver system of claim 15, wherein said roof paver elements include body portions having surfaces oriented at an acute angle with respect to said sloped surfaces, and said resilient ridges engage said surfaces of said body portions.

18. The roof paver system of claim 9, wherein said ribs include end ribs, and the end ribs of some of the roof paver elements are parallel with the end ribs of adjacent roof paver elements to define composite drainage grooves with the end ribs of said adjacent roof paver elements, some of said plurality of drainage grooves being said composite drainage grooves, and at least some of said connectors being positioned in said composite drainage grooves.

19. A roof paver system for providing ballast for a roof comprising:

a plurality of roof paver elements, each roof paver element defining openings facing adjacent roof paver elements;

a plurality of connectors positioned within the openings of the roof paver elements in order to connect each roof paver element to adjacent roof paver elements, wherein each said connector includes a tubular body having open ends and defining an axis, and at least one resilient ridge projecting laterally from said tubular body adjacent each of said open ends, each said resilient ridge being defined by a first surface substantially perpendicular to said tubular body and a second surface extending at an acute angle from said tubular body toward the axial center of said tubular body and terminating at said first surface to define an edge with said first surface, whereby said resilient ridges deform easily upon insertion into one of said openings relative to the deforming of said resilient ridges upon removal from one of said openings.

* * * * *